US008012917B2

(12) United States Patent
Johnson et al.

(10) Patent No.: US 8,012,917 B2
(45) Date of Patent: Sep. 6, 2011

(54) CROSSLINKED POLYMER

(75) Inventors: John R. Johnson, Euclid, OH (US); Daniel C. Visger, Mentor, OH (US); Marina Baum, Chagrin Falls, OH (US); Barton J. Schober, Perry, OH (US); Ying Wang, Hudson, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 211 days.

(21) Appl. No.: 12/447,999

(22) PCT Filed: Nov. 6, 2007

(86) PCT No.: PCT/US2007/083728

§ 371 (c)(1),
(2), (4) Date: Apr. 30, 2009

(87) PCT Pub. No.: WO2008/058108

PCT Pub. Date: May 15, 2008

(65) Prior Publication Data

US 2010/0004149 A1 Jan. 7, 2010

Related U.S. Application Data

(60) Provisional application No. 60/864,865, filed on Nov. 8, 2006.

(51) Int. Cl.
*C10M 145/14* (2006.01)

(52) U.S. Cl. ..... 508/452; 508/454; 508/457; 508/469; 508/470; 508/471

(58) Field of Classification Search ..... 508/452–458, 508/469, 470, 471
See application file for complete search history.

(56) References Cited

U.S. PATENT DOCUMENTS

| | | | | |
|---|---|---|---|---|
| 4,086,296 | A * | 4/1978 | Carty et al. | 525/309 |
| 5,254,669 | A * | 10/1993 | Blackborow | 528/342 |
| 5,955,405 | A | 9/1999 | Liesen et al. | |
| 6,458,749 | B2 * | 10/2002 | Kinker et al. | 508/469 |
| 7,696,138 | B2 * | 4/2010 | Mathur et al. | 508/470 |
| 2009/0118150 | A1 * | 5/2009 | Baum et al. | 508/264 |

FOREIGN PATENT DOCUMENTS

| | | | |
|---|---|---|---|
| EP | 0936225 | B1 | 5/2004 |
| EP | 0979834 | B1 | 7/2004 |
| EP | 1696020 | A2 | 8/2006 |
| GB | 759918 | | 10/1956 |
| WO | 96/23012 | | 8/1996 |
| WO | 01/40334 | A1 | 6/2001 |
| WO | 2006/047393 | A1 | 5/2006 |
| WO | 2006/047398 | A2 | 5/2006 |

OTHER PUBLICATIONS

Search Report from corresponding PCT Publication No. WO 2008/058108 A3 published Oct. 2, 2008.
Written Opinion from corresponding PCT Application No. PCT/US2007/083728 completed May 5, 2008.

* cited by examiner

*Primary Examiner* — Ellen McAvoy
(74) *Attorney, Agent, or Firm* — David M. Shold

(57) ABSTRACT

The present invention provides a lubricating composition comprising: (a) an oil of lubricating viscosity; and (b) a crosslinked polymer derived from monomers comprising: (i) 0.001 wt % to 7 wt % of a di- or higher functional crosslinking monomer; (ii) 30 wt % or higher of a hydrocarbyl-substituted (meth)acrylic monomer, wherein each hydrocarbyl contains greater than 8 carbon atoms; and (iii) 0 wt % to 40 wt % of a hydrocarbyl-substituted (meth)acrylic monomer, wherein each hydrocarbyl contains 8 or fewer carbon atoms. The invention further provides a method of preparing the crosslinked polymer and its use in a lubricating composition for lubricating an internal combustion engine.

22 Claims, No Drawings

CROSSLINKED POLYMER

FIELD OF INVENTION

The present invention relates to a novel crosslinked polymer and its use in a lubricating composition. The invention further provides a method of preparing the novel crosslinked polymer.

BACKGROUND OF THE INVENTION

The use of polymers as a rheology modifier (or viscosity modifier) or as a dispersant in an oil of lubricating viscosity is well known. Typically polymers include a polymethacrylate with physical properties that have high and low temperature viscometrics as well as shear stability. For typical linear polymers these properties are related to the polymer's molecular weight. Therefore the useful molecular weight range for lubricating compositions is limited. Polymer molecular weights chosen optimize shear performance, for example, may then result in unacceptable low temperature viscometrics or render reduced fuel economy.

In an attempt to overcome the limitations of linear polymers, star polymers have been disclosed in International publication WO 06/47398, WO 06/47393, WO96/23012 A1 and European patent applications EP 979 834 A2 and EP 936 225 A1. The star polymers of WO 06/47398, WO 06/47393 are prepared by RAFT, ATRP or nitroxide mediated stable free-radical polymerisation; whereas WO96/23012 and EP 936 225 disclose star polymers prepared from anionic polymerisation techniques.

The processing of the star polymers is complex. The star polymer disclosures describe making polymers with arm-first, core-first or arm-core-arm approaches. In addition anionic polymerisation processes require more complex processing. For instance, the process requires highly pure solvents and an inert atmosphere substantially free of water, and typically performed at sub-ambient temperatures.

It would be desirable to have a polymer suitable for use in lubricating compositions with at least one of acceptable viscosity index improving characteristics, acceptable cleanliness, acceptable shear stability, acceptable viscosity index per thickening efficiency and acceptable dispersant properties. Further it would be desirable to have a polymer prepared with less complex processing than may be used for conventional polymers, e.g., without the use of special or non-commercial catalysts/initiators, purified solvents, or sub-ambient temperatures. The present invention provides a polymer with such properties.

SUMMARY OF THE INVENTION

In one embodiment the present invention provides a lubricating composition comprising:

(a) an oil of lubricating viscosity; and (b) a crosslinked polymer derived from monomers comprising:

(i) 0.001 wt % to 7 wt % of a di- or higher functional crosslinking monomer;

(ii) 30 wt % or higher of a hydrocarbyl-substituted (meth) acrylic monomer, wherein each hydrocarbyl contains greater than 8 carbon atoms; and (iii) 0 wt % to 40 wt % of a hydrocarbyl-substituted (meth) acrylic monomer, wherein each hydrocarbyl contains 8 or fewer carbon atoms.

In one embodiment the present invention provides a lubricating composition comprising:

(a) an oil of lubricating viscosity; and (b) a crosslinked polymer derived from monomers comprising:

(i) 0.001 wt % to 7 wt % of a di- or higher functional crosslinking monomer;

(ii) 30 wt % or higher of a hydrocarbyl-substituted (meth) acrylic monomer, wherein each hydrocarbyl contains greater than 8 carbon atoms; and (iii) 0 wt % to 40 wt % of a hydrocarbyl-substituted (meth) acrylic monomer, wherein each hydrocarbyl contains 8 or fewer carbon atoms; and (iv) 0 wt % to 10 wt % of a nitrogen containing monomer.

In one embodiment the present invention provides a process for preparing a polymer comprising reacting at a temperature of 45° C. or higher:

(i) 0.001 wt % to 7 wt % of a di- or higher functional crosslinking monomer;

(ii) 30 wt % or higher of a hydrocarbyl-substituted (meth) acrylic monomer, wherein each hydrocarbyl contains greater than 8 carbon atoms;

(iii) 0 wt % to 40 wt % of a hydrocarbyl-substituted (meth) acrylic monomer, wherein each hydrocarbyl contains 8 or fewer carbon atoms;

(iv) a free radical initiator; and (v) optionally a chain transfer agent; to form a crosslinked polymer.

In one embodiment the process to prepare the polymer may be a one step process.

In one embodiment the invention provides a crosslinked polymer obtained (or obtainable) by the process described above.

In one embodiment the invention provides a crosslinked polymer derived from monomers comprising: (i) 0.001 wt % to 7 wt % of a di- or higher functional crosslinking monomer; (ii) 30 wt % or higher of a hydrocarbyl-substituted (meth) acrylic monomer, wherein each hydrocarbyl contains greater than 8 carbon atoms; and (iii) 0 wt % to 40 wt % of a hydrocarbyl-substituted (meth)acrylic monomer, wherein each hydrocarbyl contains 8 or fewer carbon atoms; and (iv) 0 wt % to 10 wt % of a nitrogen containing monomer.

In one embodiment the present invention provides a process for preparing a polymer mixture, the process comprising:

(1) adding and reacting at a temperature of 45° C. or higher:

(i) 0.001 wt % to 7 wt % of a di- or higher functional crosslinking monomer;

(ii) 30 wt % or higher of a hydrocarbyl-substituted (meth) acrylic monomer, wherein each hydrocarbyl contains greater than 8 carbon atoms;

(iii) 0 wt % to 40 wt % of a hydrocarbyl-substituted (meth) acrylic monomer, wherein each hydrocarbyl contains 8 or fewer carbon atoms; and (iv) a free radical initiator; and (v) optionally a chain transfer agent; to form a crosslinked polymer; and (2) adding or preparing a conventional polymer in the product of step (1).

In one embodiment the present invention provides a process for preparing a polymer mixture, the process comprising:

(1) preparing a conventional polymer; and (2) in the conventional polymer of step (1) adding and reacting at a temperature of 45° C. or higher:

(i) 0.001 wt % to 7 wt % of a di- or higher functional crosslinking monomer;

(ii) 30 wt % or higher of a hydrocarbyl-substituted (meth) acrylic monomer, wherein each hydrocarbyl contains greater than 8 carbon atoms;

(iii) 0 wt % to 40 wt % of a hydrocarbyl-substituted (meth) acrylic monomer, wherein each hydrocarbyl contains 8 or fewer carbon atoms; and (iv) a free radical initiator; and (v) optionally a chain transfer agent; to form a crosslinked polymer.

In one embodiment the invention provides for the use of the crosslinked polymer disclosed herein as a viscosity modifier. In one embodiment the invention provides the polymer disclosed herein as a viscosity modifier in a lubricant.

DETAILED DESCRIPTION OF THE INVENTION

The invention provides a lubricating composition comprising the polymer described above and a process to prepare said polymer.

In one embodiment the crosslinked polymer may be oil-soluble.

The weight average molecular weight of the crosslinked polymer may be 2000 to 5,000,000, or 5000 to 2,000,000, or 7500 to 1,000,000.

The polydispersity of the crosslinked polymer may be 1.01 to 20, 1.5 to 20, 2 to 16, 4 to 14 or 6 to 12.

The crosslinked polymer may be a random copolymer or a block copolymer. In one embodiment segments of the crosslinked polymer may have a homopolymer, a random copolymer or a block copolymer architecture between crosslinks of the crosslinked polymer.

In one embodiment the present invention further provides a crosslinked polymer obtained (or obtainable) by the process described above.

The process for preparing a crosslinked polymer may be carried out at a temperature in the range of 60° C. to 250° C., 70° C. to 200° C. or 80° C. to 150° C. The process may be carried out for a period of time in the range of 30 seconds to 48 hours, 2 minutes to 24 hours, 5 minutes to 16 hours, or 30 minutes to 4 hours. The process may be carried out at a pressure in the range of 86.4 kPa to 266 kPa (650 mm Hg to 2000 mm Hg), 91.8 kPa to 200 kPa (690 mm Hg to 1500 mm Hg) or 95.1 kPa to 133 kPa (715 mm Hg to 1000 mm Hg).

In one embodiment the present invention provides a process for preparing a polymer mixture, the process comprising:

(1) adding and reacting at a temperature of 45° C. or higher:

(i) 0.001 wt % to 7 wt % of a di- or higher functional crosslinking monomer;

(ii) 30 wt % or higher of a hydrocarbyl-substituted (meth) acrylic monomer, wherein each hydrocarbyl contains greater than 8 carbon atoms;

(iii) 0 wt % to 40 wt % of a hydrocarbyl-substituted (meth) acrylic monomer, wherein each hydrocarbyl contains 8 or fewer carbon atoms; and (iv) a free radical initiator; and (v) optionally a chain transfer agent; to form a crosslinked polymer; and (2) optionally, adding or preparing a conventional polymer in the product of step (1).

In one embodiment the process described above comprises preparing polymer of step (1) above in a conventional polymer.

Optionally the process further comprises steps (1) and/or (2) of preparing a conventional polymer in the crosslinked polymer, by adding and reacting a monomer mixture to form said conventional polymer. Typically the reaction temperature of steps (1) and/or (2) are carried out in the range of 20° C. to 250° C., 30° C. to 200° C. or 50° C. to 150° C. The reaction time and pressures of steps (1) and/or (2) may be similar. In one embodiment the process further comprises preparing a conventional polymer in the crosslinked polymer.

The conventional polymer in other embodiment may be a linear polymer; or a star polymer; or mixtures of linear and star polymers. The conventional polymer is defined in more detail as a conventional, non-crosslinked viscosity modifier as defined below. In one embodiment the conventional polymer may be prepared by reacting the same a hydrocarbyl-substituted (meth)acrylic monomer as is reacted from (ii) and/or (iii) above.

Typically the reactants of step (1) may be at least 50% reacted or at least 80% reacted before commencing step (2). In one embodiment the reactants of step (1) are substantially completed depleted resulting in a final product that may be relatively unreactive towards products of step (2). In another embodiment the reactants of step (1) are partially reacted before carrying out steps (2).

In one embodiment the product of step (1) acts as a polymerisation medium during the formation of the conventional linear polymer. Therefore step (2) of the process occurs in the presence of the product of step (1) allowing the formation of a mixture of polymers from step (1) and step (2). The resultant mixtures of polymers typically have weight percent ratio of crosslinked polymer to conventional polymer of 1:99 to 99:1, 10:90 to 70:30 or 20:80 to 50:50.

The polymer of steps (1) and/or (2) may be prepared by a one or two pot process. Further the polymer of steps (1) and/or (2) may be prepared by a one step process or in a multi-step process.

In one embodiment the process comprises step (1). In one embodiment the process comprises steps (1) and (2). In one embodiment the process comprises preparing the crosslinked polymer of step (1) in a conventional polymer.

In a one step process, substantially all to all of reactants (i)-(iv), are added to a reaction vessel before polymerisation.

In a multi-step process reactants (i)-(iv) may be initially added with further additions as required. A person skilled in the art will appreciate that it is also possible to prepare the crosslinked polymer by initially adding in the multi-step process different amounts of reactants.

In one embodiment the crosslinked polymer may be prepared by known polymerisation techniques, for example free radical polymerisation or controlled free radical polymerisation. Examples of a controlled free radical polymerisation process include atom transfer radical polymerisation (ATRP) or a nitroxide-mediated stable free-radical polymerisation process. Matyjaszewski et al. (see Chapter 11, pages 523 to 628 for ATRP; and Chapter 10, pages 463 to 522 for nitroxide-mediated of the "Handbook of Radical Polymerization", Edited by Krzysztof Matyjaszewski and Thomas P. Davis, Copyright 2002 and published by John Wiley and Sons Inc.) discloses possible mechanisms for the formation of the crosslinked polymer by ATRP or nitroxide-mediated stable free-radical polymerisation processes as described above. A reversible addition-fragmentation chain transfer (RAFT) polymerisation may also be employed (see Chapter 12, pages 629 to 690 of the "Handbook of Radical Polymerization", Edited by Krzysztof Matyjaszewski and Thomas P. Davis). In one embodiment the controlled free radical polymerisation is selected from the group consisting of reversible addition-fragmentation chain transfer, atom transfer radical polymerisation and nitroxide-mediated stable free-radical polymerisation.

In one embodiment the process excludes anionic polymerisation techniques because said techniques require highly pure solvents, an inert atmosphere substantially free of water, low reaction temperatures and the use of metal (for example alkali metals) carbanionic initiators.

Typically the crosslinked polymer may be substantially free of to free of a core (resulting the crosslinked polymer not being a star polymer). In one embodiment is not a star-polymer.

In one embodiment the crosslinked polymer is substantially free of to free of a metal or silicon.

Di- or Higher Functional Crosslinking Monomer

An important feature of the present application is the crosslinked polymer is lightly crosslinked. The lightly crosslinked polymer is derived from 0.001 wt % to 7 wt % of a di- or higher functional crosslinking monomer. The amount of di- or higher functional crosslinking monomer is present in an amount to diminish the possibility to form a gelled polymer. In one embodiment the crosslinked polymer is not gelled, i.e., the polymer has not reached gelation point A person skilled in the art will appreciate that when higher concentrations of the crosslinking monomer are used to prepare the crosslinked polymer, it may be desirable to have higher concentrations of free radical initiators and/or chain transfer agents. The higher concentrations of free radical initiators and/or chain transfer agents are believed to decrease the possibility of forming a gelled polymer. The appropriate adjustments to the concentrations of the free radical initiaitors and/or chain transfer agents will be apparent to a person skilled in the art.

In other embodiments the di- or higher functional crosslinking monomer may be present at 0.05 wt % to 6 wt %, 0.075 wt % to 3 wt %, or greater than 3 wt % to 5.5 wt % of the crosslinked polymer.

The di- or higher functional crosslinking monomer includes free radically polymerisable moieties. These moieties may have the same or different reactivity towards free radicals. These moieties typically include unsaturation. Examples of moieties include (meth)acrylic, allyl, vinyl, styryl, conjugated double bonds, or mixtures thereof.

In other embodiments the di- or higher functional crosslinking monomer comprises a polyfunctional pentaerythritol mono(meth)acrylate, a polyfunctional (meth) acrylate, divinyl non-acrylic monomer (for instance divinyl benzene), a polyfunctional (meth)acrylic monomer (for example an acrylate or methacrylate ester of a polyol or polyamine). In one embodiment the functional crosslinking monomer comprises a tri-functional or higher crosslinking monomer.

Examples of a polyvalent (meth)acrylic monomer include a di(meth)acrylate, tri(meth)acrylate, tetra(meth)acrylate or reactive equivalents thereof, or a polyamine or polyamide (such as an amide of a polyamine, for instance a methacrylamide or an acrylamide) or reactive equivalents thereof.

Examples of a di- or higher functional crosslinking monomer include divinylbenzene, dipentaerythritol hexamethacrylate, dipentaerythritol hexaacrylate, tripentaerythritol octamethacrylate, tripentaerythritol octaacrylate, pentaerythritol tetraacrylate, pentaerythritol tetramethacrylate, bisacrylates and methacrylates of polyethylene glycols of molecular weight 200-4000, polycaprolactonediol diacrylate, pentaerythritol triacrylate, pentaerythritol trimethacrylate, 1,1,1-trimethylolpropane triacrylate, pentaerythritol diacrylate, pentaerythritol tetraacrylate, triethylene glycol diacrylate, triethylene glycol dimethacrylate, 1,1,1-trimethylolpropane trimethacrylate, hexamethylenediol diacrylate or hexamethylenediol dimethacrylate or an alkylene bis-(meth) acrylamide.

Examples of a di- or higher crosslinking monomer with allyl moieties include allyl sucrose, trimethylolpropane diallyl ether, allyl pentaerythritol, or mixtures thereof.

Examples of di- or higher crosslinking monomer containing moieties with different reactivities towards free radicals include allyl methacrylate, allyl acrylate, propoxylated allyl methacrylates (commercially available from Sartomer including CD513®), propoxylated allyl acrylates, ethoxylated allyl methacrylates (commercially available from 3B Scientific Corporation, Amfinecom Inc, and Monomer-Polymer & Dajac Laboratories Inc), ethoxylated allyl acrylates, or mixtures thereof.

The crosslinking monomer may be present as a portion of the monomer charge at the beginning of the polymerisation. The incorporation of the crosslinking monomer into the polymer may be a function of (i) relative reactivity and (ii) concentration of the crosslinking monomer (studied in "Principles of Polymerisation, 3rd Edition", George Odian, John Wiley & Sons, Inc., 1991, pages 510-512). In some cases where there are larger differences in the reactivity of the crosslinking monomer as compared to non-crosslinking monomer there may be some drift in the amount of crosslinking monomer in chains formed early in the polymerisation as compared to those formed toward the end of the polymerisation. One skilled in the art fully appreciates that if the crosslinking monomer has a lower reactivity then the other monomer that the polymers formed early will have less crosslinking monomer. As the polymerisation continues the relative concentration of the crosslinking monomer rises as a greater proportion of the other monomer is consumed. Therefore the amount of crosslinking monomer in chains formed late in the reaction will be higher due to the effect of this increased concentration. It is clear to one skilled in the art, however, that these monomers are still incorporated throughout each chain.

A person skilled in the art will appreciate that if the crosslinking monomer is added at the end of polymerisation, the polymers formed by such a process are likely to be outside the scope of the present invention.

In various embodiments the reactivity of the hydrocarbyl-substituted (meth)acrylic monomers and that of the crosslinking monomer may be identical, similar or different. If the reactivity of the hydrocarbyl-substituted (meth)acrylic monomers and that of the crosslinking monomer are different, the difference may be less than 30%, or less than 20%, or less than 10%.

When the higher functional crosslinking monomer is a multifunctional methacrylate, the reactivity of the crosslinking monomer may be approximately equivalent to that of the hydrocarbyl-substituted (meth)acrylic monomers (see "Principles of Polymer Chemistry", Paul Flory, Cornell University Press, 1953, pages 391).

A person skilled in the art will also appreciate that the amount of crosslinking monomer may be varied depending on the amount of chain transfer agent and/or free radical initiator used. Typically, in the presence of a chain transfer agent higher levels of di- or higher functional crosslinking monomer may be used. Conversely, in the absence or presence of reduced amounts of chain transfer agent, reduced amounts of di- or higher functional crosslinking monomer are required.

(Meth)Acrylic Monomer

The expression "hydrocarbyl-substituted (meth)acrylic monomer" includes methacrylate esters, acrylate esters, methacrylamides, acrylamides, acrylic acid, methacrylic acid, acrylonitrile, methacrylonitrile as well as mixtures thereof, or reactive equivalents thereof.

In one embodiment the expression "hydrocarbyl-substituted (meth)acrylic monomer" includes methacrylate esters, acrylate esters, methacrylamides, acrylamides as well as mixtures thereof, or reactive equivalents thereof.

(Meth)Acrylic Monomer Containing Greater than 8 Carbon Atoms

In other embodiments the hydrocarbyl-substituted (meth) acrylic monomer contains a hydrocarbyl with 9 or more carbon atoms or 10 or more carbon atoms For example, the hydrocarbyl group in a (meth)acrylate (ester), derived from the alcohol precursor of the ester, may have at least 9 carbon atoms. The maximum number of carbon atoms present on the hydrocarbyl-substituted (meth)acrylic monomer in other embodiments may be up to 40, up to 30, up to 26, up to 22 or up to 18, or up to 15.

Examples of ranges for the number of carbon atoms present on the hydrocarbyl include 9 to 40, 9 to 30, 12 to 18, or 12 to 15.

In other embodiments the hydrocarbyl-substituted (meth) acrylic monomer wherein each hydrocarbyl contains greater than 8 carbon atoms may be present from 30 wt % or higher, 35 wt % to 99.999, 45 wt % to 99.85 wt %, 60 wt % to 99.825 wt %, or 75 wt % to 99.625 wt % of the crosslinked polymer.

The hydrocarbyl-substituted (meth)acrylic monomer may be a methacrylate or acrylate monomer, wherein each hydrocarbyl contains greater than 8 carbon atoms. Examples of said monomer include nonyl(meth)acrylate, isooctyl(meth)acrylate, isononyl(meth)acrylate, 2-tert-butylheptyl(meth)acrylate, 3-isopropylheptyl(meth)acrylate, decyl(meth)acrylate, undecyl(meth)acrylate, 5-methylundecyl(meth)acrylate, dodecyl(meth)acrylate, 2-methyldodecyl (meth)acrylate, tridecyl(meth)acrylate, 5-methyltridecyl(meth)acrylate, tetradecyl(meth)acrylate, pentadecyl(meth)acrylate, hexadecyl (meth)acrylate, 2-methylhexadecyl(meth)acrylate, eicosyl (meth)acrylate, heptadecyl (meth)acrylate, 5-isopropylheptadecyl(meth)acrylate, 4-tert-butyloctadecyl (meth)acrylate, 5-ethyloctadecyl(meth)acrylate, 3-isopropyloctadecyl(meth) acrylate, octadecyl(meth)acrylate, nonadecyl(meth)acrylate, cetyleicosyl (meth)acrylate, stearyleicosyl(meth)acrylate, docosyl(meth)acrylate and/or eicosyltetratriacontyl(meth)acrylate; (meth)acrylates derived from alcohols, such as oleyl(meth)acrylate; cycloalkyl(meth)acrylates, such as 3-vinyl-2-butyl cyclohexyl(meth)acrylate or bornyl(meth)acrylate.

The methacrylate or acrylate ester compounds may be derived from the reaction of methacrylic or acrylic acid with an alcohol containing 8 or more carbon atoms. Examples of suitable alcohols include Oxo Alcohol® 7911, Oxo Alcohol® 7900 and Oxo Alcohol® 1100 of Monsanto; Alphanol® 79 of ICI; Nafol® 1620, Alfol® 610 and Alfol® 810 of Condea; Epal® 610 and Epal® 810 of Ethyl Corporation; Linevol® 79, Linevol® 911, Neodol®25 and Dobanol® 25 L of Shell AG; Lial® 125 of Condea Augusta, Milan; Dehydad® and Lorol® of Henkel KGaA as well as Linopol® 7-11 and Acropol® 91 of Ugine Kuhlmann.

(Meth)Acrylic Monomer Containing 8 or Fewer Carbon Atoms

Optionally the crosslinked polymer may be derived from a hydrocarbyl-substituted (meth)acrylic monomer, wherein each hydrocarbyl contains 8 or fewer carbon atoms. In other embodiments the number of carbon atoms present in the hydrocarbyl may be 1 to 8, 1 to 6, 1 to 4 or 1 to 2.

In other embodiments the hydrocarbyl-substituted (meth) acrylic monomer, wherein each hydrocarbyl contains 8 or fewer carbon atoms may be present from 0 wt % to 40 wt %, 0 wt % to 30 wt %, 0.05 wt % to 20 wt %, or 0.1 wt % to 10 wt % of the crosslinked polymer.

In one embodiment the hydrocarbyl-substituted (meth) acrylic monomer wherein each hydrocarbyl contains 8 or fewer carbon atoms is a methacrylate or acrylate ester. Examples of a suitable ester include 2-ethylhexyl(meth)acrylate, octyl(meth)acrylate, methyl(meth)acrylate, butyl (meth) acrylate or hexyl(meth)acrylate or mixtures thereof.

Nitrogen Containing Monomer (b)(iv)

In one embodiment the crosslinked polymer is further derived from a nitrogen containing monomer or mixtures thereof. A nitrogen containing monomer may also be described as a dispersant monomer.

Typically the nitrogen containing monomer may be reacted with monomers defined in (b)(i) and/or (b)(ii) when the hydrocarbyl-substituted (meth)acrylic monomer is methacrylic acid, acrylic acid, methacrylate esters or an acrylate esters.

The nitrogen containing monomer includes a vinyl substituted nitrogen heterocyclic monomer, a dialkylaminoalkyl (meth)acrylate monomer, a dialkylaminoalkyl(meth)acrylamide monomer, a tertiary-(meth)acrylamide monomer or mixtures thereof.

Examples of a suitable nitrogen containing monomer include vinyl pyridine, N-vinyl imidazole, N-vinyl pyrrolidinone, and N-vinyl caprolactam, dimethylaminoethyl acrylate, dimethylaminoethyl methacrylate, dimethylaminopropyl methacrylate or mixtures thereof, or reactive equivalents thereof.

In one embodiment the crosslinked polymer may further comprise a (meth)acrylamide or a nitrogen containing (meth) acrylate monomer that may be represented by the formula:

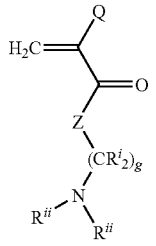

wherein

Q is hydrogen or methyl and, in one embodiment, Q is methyl;

Z is an N—H group or O (oxygen);

each $R^{ii}$ is independently hydrogen or a hydrocarbyl group containing 1 to 8, or 1 to 4 carbon atoms;

each $R^i$ is independently hydrogen or a hydrocarbyl group containing 1 to 2 carbon atoms and, in one embodiment, each $R^i$ is hydrogen; and g is an integer from 1 to 6 and, in one embodiment, g is 1 to 3.

Examples of a suitable nitrogen-containing monomer include N,N-dimethylacrylamide, N-vinyl carbonamides such as N-vinyl-formamide, vinyl pyridine, N-vinylacetoamide, N-vinyl-n-propionamides, N-vinyl hydroxyacetoamide, N-vinyl imidazole, N-vinyl pyrrolidinone, N-vinyl caprolactam, dimethylaminoethyl acrylate (DMAEA), dimethylaminoethylmethacrylate (DMAEMA), dimethylaminobutylacrylamide, dimethylamine-propylmethacrylate (DMAPMA), dimethylamine-propyl-acrylamide, dimethylaminopropylmethacrylamide, dimethylaminoethyl-acrylamide or mixtures thereof.

The crosslinked polymer may include a nitrogen containing monomer present in other embodiments from 0 wt % to 10 wt %, 0.1 wt % to 8 wt %, 0.1 wt % to 4 wt % or 0.2 wt % to 2 wt % of the crosslinked polymer.

In specific embodiments the crosslinked polymer compositions may be:

| | wt % of monomers | | | |
|---|---|---|---|---|
| Embodiments | (b)(i) | (b)(ii) | (b)(iii) | (b)(iv) |
| 1 | 0.001 to 7 | 35 to 99.999 | 0 to 40 | 0 to 10 |
| 2 | 0.05 to 6 | 45 to 99.85 | 0 to 30 | 0.1 to 8 |
| 3 | 0.075 to 3 | 60 to 99.825 | 0 to 20 | 0 to 4 |
| 4 | 0.075 to 3 | 75 to 99.625 | 0.1 to 10 | 0.2 to 2 |
| 5 | 3 to 5.5 | 60 to 97 | 0 to 20 | 0 to 4 |
| 6 | 3 to 5.5 | 75 to 96.7 | 0.1 to 10 | 0.2 to 2 |

(where (b)(i), (b)(ii), (b)(iii) and (b)(iv) are defined above)

Optionally the crosslinked polymer further comprises a non-(meth)acrylic monomer such as styrene, an olefin or an acylating agent such as maleic anhydride. The non-(meth) acrylic monomer may be present in other embodiments from 0 wt % to 10 wt %, 0 wt % to 8 wt %, 0 wt % to 6 wt % or 0 wt % to 2 wt % or 0.1 to 2 wt. % of the crosslinked polymer.

Free Radical Initiator

The free radical initiator of the invention is known and includes peroxy compounds, peroxides, hydroperoxides, and azo compounds which decompose thermally to provide free radicals. Other suitable examples are described in J. Brandrup and E. H. Immergut, Editor, "Polymer Handbook", 2nd edition, John Wiley and Sons, New York (1975), pages II-1 to II-40.

Examples of a free radical initiator include those derived from a free radical-generating reagent and examples include benzoyl peroxide, t-butyl perbenzoate, t-butyl metachloroperbenzoate, t-butyl peroxide, sec-butylperoxydicarbonate, azobisisobutyronitrile, t-butyl peroxide, t-butyl hydroperoxide, t-amyl peroxide, cumyl peroxide, t-butyl peroctoate, t-butyl-m-chloroperbenzoate, azobisisovaleronitrile or mixtures thereof. In one embodiment the free radical generating reagent may be at least one of t-butyl peroxide, t-butyl hydroperoxide, t-amyl peroxide, cumyl peroxide, t-butyl peroctoate, t-butyl-m-chloroperbenzoate, azobisisovaleronitrile or mixtures thereof. Commercially available free radical initiators include Trigonox™-21 from Ciba Specialty Chemicals.

The free radical initiator may be present in other embodiments from 0.01 wt % to 10 wt % or from 0.05 wt % to 2 wt % based on the total weight of the hydrocarbyl-substituted (meth)acrylic monomers.

Chain Transfer Agent

Optionally the invention requires a chain transfer agent. In one embodiment the process for preparing the crosslinked polymer further comprises at least one chain transfer agent. A person skilled in the art will appreciate that specific classes of chain transfer agent are required for certain polymerisation techniques.

Examples of a suitable chain transfer agent include xylene, toluene, t-dodecylmercaptan, isopropyl alcohol or mixtures thereof.

In one embodiment the chain transfer agent is suitable for a RAFT polymerisation technique. A detailed description of suitable RAFT chain transfer agents is disclosed in U.S. Patent Application 60/621,745 filed on Oct. 25, 2004, now WO 2006/047393 and U.S. Patent Application 60/621,875 filed on Oct. 25, 2004, now WO 2006/047398.

Examples of a suitable RAFT chain transfer agent include benzyl 1-(2-pyrrolidinone)carbodithioate, benzyl(1,2-benzenedicarboximido) carbodithioate, 2-cyanoprop-2-yl 1-pyrrolecarbodithioate, 2-cyanobut-2-yl 1-pyrrolecarbodithioate, benzyl 1-imidazolecarbodithioate, N,N-dimethyl-S-(2-cyanoprop-2-yl)dithiocarbamate, N,N-diethyl-5-benzyl dithiocarbamate, cyanomethyl 1-(2-pyrrolidone)carbodithoate, cumyl dithiobenzoate, 2-dodecylsulphanylthiocarbonylsulphanyl-2-methyl-propionic acid butyl ester, O-phenyl-5-benzyl xanthate, N,N-diethyl S-(2-ethoxy-carbonylprop-2-yl)-dithiocarbamate, dithiobenzoic acid, 4-chlorodithiobenzoic acid, O-ethyl-S-(1-phenylethyl)xanthtate, O-ethyl-S-(2-(ethoxycarbonyl)prop-2-yl)xanthate, O-ethyl-S-(2-cyanoprop-2-yl)xanthate, O-ethyl-S-(2-cyanoprop-2-yl)xanthate, O-ethyl-5-cyanomethyl xanthate, O-pentafluorophenyl-5-benzyl xanthate, 3-benzylthio-5,5-dimethylcyclohex-2-ene-1-thione or benzyl 3,3-di(benzylthio)-prop-2-enedithioate, S,S'-bis-(α,α'-disubstituted-α"-acetic acid)-trithiocarbonate, S,S'-bis-(α,α'-disubstituted-α"-acetic acid)-trithiocarbonate or S-alkyl-S'-(α,α'-disubstituted-α"-acetic acid)-trithiocarbonates, benzyl dithiobenzoate, 1-phenylethyl dithiobenzoate, 2-phenylprop-2-yl dithiobenzoate, 1-acetoxyethyl dithiobenzoate, hexakis (thiobenzoylthiomethyl)benzene, 1,4-bis(thiobenzoylthiomethyl)benzene, 1,2,4,5-tetrakis(thiobenzoylthiomethyl) benzene, 1,4-bis-(2-(thiobenzoylthio)prop-2-yl)benzene, 1-(4-methoxyphenyl)ethyl dithiobenzoate, benzyl dithioacetate, ethoxycarbonylmethyl dithioacetate, 2-(ethoxycarbonyl)prop-2-yl dithiobenzoate, 2,4,4-trimethylpent-2-yl dithiobenzoate, 2-(4-chlorophenyl)prop-2-yl dithiobenzoate, 3-vinylbenzyl dithiobenzoate, 4-vinylbenzyl dithiobenzoate, S-benzyl diethoxyphosphinyldithioformate, tert-butyl trithioperbenzoate, 2-phenylprop-2-yl 4-chlorodithiobenzoate, 2-phenylprop-2-yl 1-dithionaphthalate, 4-cyanopentanoic acid dithiobenzoate, dibenzyl tetrathioterephthalate, dibenzyl trithiocarbonate, carboxymethyl dithiobenzoate or poly(ethylene oxide) with dithiobenzoate end group or mixtures thereof.

The amount of chain transfer agent present in the process in other embodiments includes 0 to 10 wt %, or 0.5 to 2 wt % based on the weight of monomer.

Lubricating Composition

In one embodiment the present invention provides a lubricating composition comprising:

(a) an oil of lubricating viscosity; and (b) a crosslinked polymer derived from monomers comprising:

(i) 0.001 wt % to 7 wt % of a di- or higher functional crosslinking monomer;

(ii) 30 wt % or higher of a hydrocarbyl-substituted (meth) acrylic monomer, wherein each hydrocarbyl contains greater than 8 carbon atoms; and (iii) 0 wt % to 40 wt % of a hydrocarbyl-substituted (meth) acrylic monomer, wherein each hydrocarbyl contains 8 or fewer carbon atoms.

In one embodiment the present invention provides a lubricating composition comprising:

(a) an oil of lubricating viscosity; and (b) a crosslinked polymer derived from monomers comprising:

(i) 0.001 wt % to 7 wt % of a di- or higher functional crosslinking monomer;

(ii) 30 wt % or higher of a hydrocarbyl-substituted (meth) acrylic monomer, wherein each hydrocarbyl contains greater than 8 carbon atoms; and (iii) 0 wt % to 40 wt % of a hydrocarbyl-substituted (meth) acrylic monomer, wherein each hydrocarbyl contains 8 or fewer carbon atoms; and (c) a conventional viscosity modifier.

Conventional Viscosity Modifier

In one embodiment of the invention the lubricating composition further comprises a conventional viscosity modifier, that is, not a crosslinked viscosity modifier as described hereinabove or mixtures thereof. Typically the conventional viscosity modifier may be a linear (or substantially linear) polymer or a star polymer.

In one embodiment the conventional viscosity modifier includes hydrogenated copolymers of styrene-butadiene, polyolefins, olefin copolymers such as ethylene-propylene polymers, polyisobutenes, hydrogenated styrene-isoprene polymers, hydrogenated isoprene polymers, polymethacrylate acid esters, polyacrylate acid esters, polyalkylstyrenes, hydrogenated alkenyl arene conjugated diene copolymers, polyalkylmethacrylates and esters of maleic anhydride-styrene copolymers. In one embodiment the conventional viscosity modifier comprises polymethacrylate acid esters, polyacrylate esters or mixtures thereof. In another embodiment the polymethacrylate esters, polyacrylate esters are linear or star. In one embodiment olefin based polymers may be branched.

In other embodiments the conventional viscosity modifier has a weight average molecular weight of more than 5000, 10,000 or more, or 20,000 or 30,000 or more. Examples of suitable ranges for the number average molecular weight include 5000 to 1,000,000, 10,000 to 100,000, 15,000 to 50,000, or 20,000 to 30,000.

In other embodiments the amount of the conventional viscosity modifier present in the lubricating composition of the invention may be 0 wt % to 50 wt %, 1 wt % to 50 wt %, 1 wt % to 35 wt %, 1.5 wt % to 30 wt % or 2 wt % to 20 wt %.

Oil of Lubricating Viscosity

In one embodiment the lubricating composition includes natural or synthetic oils of lubricating viscosity, oil derived from hydrocracking, hydrogenation, hydrofinishing, unrefined, refined and re-refined oils or mixtures thereof.

Natural oils include animal oils, vegetable oils, mineral oils or mixtures thereof. Synthetic oils include a hydrocarbon oil, a silicon-based oil, a liquid esters of phosphorus-containing acid. Synthetic oils may be produced by Fischer-Tropsch reactions and typically may be hydroisomerised Fischer-Tropsch hydrocarbons or waxes.

Oils of lubricating viscosity may also be defined as specified in the American Petroleum Institute (API) Base Oil Interchangeability Guidelines. In other embodiments the oil of lubricating viscosity comprises an API Group I, II, III, IV, V, VI or mixtures thereof, or an API Group I, II, III or mixtures thereof. If the oil of lubricating viscosity may be an API Group II, III, IV, V or VI oil there may be up to 40 wt % or up to a maximum of 5 wt % of the lubricating oil an API Group I oil.

In one embodiment the lubricating composition has a SAE viscosity grade from XW-Y, wherein X may be an integer from 0 to 85 and Y is an integer from 20 to 250.

In other embodiments X may be an integer chosen from 0, 5, 10, 15, 20, 70, 75, 80 or 85; and Y may be an integer chosen from 20, 25, 30, 35, 40, 45, 50, 90, 110, 140 190 or 250.

In other embodiments the oil of lubricating viscosity may be present from 5 wt % to 99.9 wt %, or from 25 wt % to 98.9 wt %, or from 40 wt % to 97.9 wt %, or from 60 wt % to 96.5 wt % of the lubricating composition.

Additional Performance Additive

The composition optionally further includes at least one additional performance additive. The additional performance additive including metal deactivators, detergents, dispersants, friction modifiers, dispersant viscosity modifiers, extreme pressure agents, antiwear agents, antioxidants, corrosion inhibitors, foam inhibitors, demulsifiers, pour point depressants, seal swelling agents or mixtures thereof.

In other embodiments the total combined amount of the additional performance additive compounds are present from 0 wt % to 25 wt %, 0.01 wt % to 20 wt %, 0.1 wt % to 15 wt % or 0.5 wt % to 10 wt % of the composition. Although one or more of the additional performance additives may be present, it is common for the additional performance additives to be present in different amounts relative to each other.

If the present invention is in the form of a concentrate (which can be combined with additional oil to form, in whole or in part, a finished lubricant), the ratio of the crosslinked polymer of the invention and the optional additional performance additives in an oil of lubricating viscosity, to diluent oil including may be in the range of 80:20 to 10:90 by weight.

Antioxidants include molybdenum dithiocarbamates, sulphurised olefins, hindered phenols, diphenylamine. Detergents include neutral or overbased, Newtonian or non-Newtonian, basic salts of alkali, alkaline earth and transition metals with one or more of a phenate, a sulphurised phenate, a sulphonate, a carboxylic acid, a phosphorus acid, a mono- and/or a di-thiophosphoric acid, a saligenin, an alkylsalicylate, or a salixarate. Dispersants include N-substituted long chain alkenyl succinimide as well as posted treated version thereof. Post-treated dispersants include those treated by reaction with urea, thiourea, dimercaptothiadiazoles, carbon disulphide, aldehydes, ketones, carboxylic acids, hydrocarbon-substituted succinic anhydrides, nitriles, epoxides, boron compounds, or phosphorus compounds. Viscosity modifiers include hydrogenated copolymers of styrene-butadiene, polyolefins, olefin copolymers such as ethylene-propylene polymers, polyisobutenes, hydrogenated styrene-isoprene polymers, hydrogenated isoprene polymers, polymethacrylate acid esters, polyacrylate acid esters, polyalkylstyrenes, alkenyl arene conjugated diene copolymers, polyalkylmethacrylates and esters of maleic anhydride-styrene copolymers.

Antiwear agents include compounds such as metal thiophosphates, especially zinc dialkyldithiophosphates; phosphoric acid esters or salt thereof; phosphites; and phosphorus-containing carboxylic esters, ethers, and amides. Antiscuffing agents including organic sulphides and polysulphides, such as benzyldisulphide, bis-(chlorobenzyl) disulphide, dibutyl tetrasulphide, di-tertiary butyl polysulphide, di-tert-butylsulphide, sulphurised Diels-Alder adducts or alkyl sulphenyl N'N-dialkyl dithiocarbamates. Extreme Pressure (EP) agents including chlorinated wax, organic sulphides and polysulphides, such as benzyldisulphide, bis-(chlorobenzyl) disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons, metal thiocarbamates, such as zinc dioctyldithiocarbamate and barium heptylphenol diacid. Any of the above classes of additives may also be used in the composition of the invention.

Additionally the invention may also include friction modifiers including fatty amines, esters such as borated glycerol esters, fatty phosphites, fatty acid amides, fatty epoxides, borated fatty epoxides, alkoxylated fatty amines, borated alkoxylated fatty amines, metal salts of fatty acids, fatty imidazolines, condensation products of carboxylic acids and polyalkylene-polyamines, amine salts of alkylphosphoric acids.

The formulation of the invention may also include dispersant viscosity modifiers (often referred to as DVM), including functionalised polyolefins, for example, ethylene-propylene copolymers that have been functionalized by reaction with maleic anhydride and then an amine; polymethacrylates functionalised with an amine, or styrene-maleic anhydride copolymers reacted with an amine.

Other performance additives such as corrosion inhibitors including octylamine octanoate, condensation products of dodecenyl succinic acid or anhydride and a fatty acid such as oleic acid with a polyamine; metal deactivators including derivatives of benzotriazoles, 1,2,4-triazoles, benzimidazoles, 2-alkyldithiobenzimidazoles or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides; and seal swell agents including Exxon Necton-37™ (FN 1380) and Exxon Mineral Seal Oil (FN 3200); may also be used in the composition of the invention.

INDUSTRIAL APPLICATION

The crosslinked polymer of the present invention may be useful as a viscosity index improving (viscosity modifier) additive. In other embodiments the crosslinked polymer may be suitable for a transmission fluid, a gear oil, a hydraulic fluid or an internal combustion engine lubricant, for example, for diesel fuelled engines, gasoline fuelled engines, natural gas fuelled engines or mixed gasoline/alcohol fuelled engines.

In one embodiment of the invention provides a method for lubricating a transmission, a gear, a hydraulic device or an internal combustion engine, comprising supplying thereto a lubricant comprising the crosslinked polymer and optionally a conventional polymer as described herein.

The use of the crosslinked polymer in a transmission fluid, a gear oil, a hydraulic fluid or an internal combustion engine, may impart one or more properties including acceptable cleanliness, acceptable shear stability, acceptable viscosity index, acceptable viscometrics (i.e. low temperature viscometrics or acceptable high temperature viscometrics), acceptable fuel economy and acceptable dispersant properties.

In other embodiments the crosslinked polymer may be present in a lubricating composition from 0.001 wt % to 30 wt %, 0.1 wt % to 20 wt %, 0.5 wt % to 15 wt %, 1 wt % to 10 wt % or from 2 wt % to 8 wt % of the lubricating composition.

The following examples provide illustrations of the invention. These examples are non-exhaustive and are not intended to limit the scope of the invention.

EXAMPLES

Example 1 (EX1): A polymerisation reaction is carried out in a vessel equipped with stirrer, thermocouple, reflux condenser, and pressure equalising dropping funnel. The pressure equalising dropping funnel is charged with $C_{12-15}$ alkyl methacrylate (68.2 g), 2-ethylhexyl methacrylate (30 g), trimethylolpropane trimethacrylate (TMPTMA) (0.31 g), dodecyl mercaptan (5 g), Trigonox®-21 initiator (5 g) and 105.3 g of mineral oil. The vessel is purged with nitrogen with a flow rate of 7.87 $cm^3/s$ (or 1.0 scfh) and stirred at ambient temperature for 45 minutes. The vessel is then heated to 111° C. over 20 minutes. Dimethylaminopropyl methacrylamide (DMAPMA) (1.82 g) is then added to the vessel. The nitrogen flow rate is then reduced to 0.79 $cm^3/s$ (or 0.1 scfh). The contents of the pressure equalising dropping funnel are added dropwise to the vessel over a period of 1 hour. The vessel is then held at 110° C. for a further 2 hours, followed by an addition of 0.5 g Trigonox®-21 initiator in 5 g oil. The vessel is held at a temperature of 106° C. to 110° C. for 65 minutes. The vessel is cooled to ambient and the product is removed. The final product is a viscous light yellow fluid with a weight average molecular weight of 41,300.

Example 2 (EX2): A polymerisation reaction is carried out in a vessel equipped with stirrer, thermocouple, reflux condenser, and pressure equalising dropping funnel. The pressure equalising dropping funnel is charged with $C_{12-15}$ alkyl methacrylate (70 g), 2-ethylhexyl methacrylate (30 g), trimethylolpropane trimethacrylate (TMPTMA) (0.425 g), dodecyl mercaptan (1.25 g), Trigonox®-21 initiator (6 g) and 25 g of mineral oil. The vessel is purged with nitrogen with a flow rate of 7.87 $cm^3/s$ (or 1.0 scfh) and stirred at ambient temperature for 30 minutes. The nitrogen flow rate is then reduced to 0.79 $cm^3/s$ (or 0.1 scfh). The vessel is then placed in an oil bath at 95° C. The vessel contents react producing an exotherm of 124° C. The vessel is then held at 124° C. for 1 hour, before cooling to ambient. The product is removed and analysed. The product is a viscous light yellow fluid with weight average molecular weight of 69,300.

Examples 3 to 5 (EX3 to EX5) are prepared by reacting $C_{12}$-$C_{15}$-alkyl methacrylate, trimethylolpropane trimethacrylate (TMPTMA), 2-ethylhexyl methacrylate, dimethylaminopropyl methacrylamide, Trigonox®21 and n-dodecylmercaptan in a similar process to EX2. The amounts of various monomers used to prepare EX3 to EX5 are defined in the following table:

| Example | Amount of TMPTMA (wt % monomers) | $M_w$ (1000's) | Polydispersity {"PDI"} | Mp* |
|---|---|---|---|---|
| EX3 | 0.85 | 132, | 8.7 | 17,000 |
| EX4 | 0.90 | 253 | 13 | 32,678 |
| EX5 | 0.95 | 117 | 7.1 | 19,710 |

Footnote: where Mp is peak molecular weight.

Example 6 is prepared by a similar process to EX1, except the chain transfer agent is cumyl dithiobenzoate (1.0 g). The monomers reacted are $C_{12-15}$ methacrylate (96 g), 2-ethylhexyl methacrylate (41 g), trimethylolpropane trimethacrylate (1.19 g), as well as diluent oil (48 g) and Trigonox 21 (0.40 g), which are charged to the reactor, and a nitrogen atmosphere is established in the vessel. The vessel is placed in a preheated oil bath at 90° C. The reaction mixture is maintained at 90° C. for 12 hours. The product has a weight average molecular weight of about 390,000 with a PDI of 7.5.

Example 7 (EX7): A polymerisation reaction is carried out in a vessel equipped with stirrer, thermocouple, reflux condenser, pressure equalising dropping funnel, and a nitrogen inlet flowing at 3.95 $cm^3/s$ (or 0.5 scfh). The pressure equalising dropping funnel is charged with the mixture of butyl methacrylate (54 g), methyl methacrylate (54 g), C12-14 methacrylate (141 g), C16-18 methacrylate (51 g), allyl methacrylate (1.5 g), mineral oil (131.25 g), Trigonox®-21 initiator (1.05 g), and n-dodecyl mercaptan (1.05 g) One-third of this mixture is transferred to the vessel, which is then heated to 110° C. After the polymerisation exotherms, the remaining two-thirds mixture in the addition funnel is added dropwise to the vessel over a period of 1.5 hours. One hour after the addition is complete, final residual monomer finish-up is conducted by adding Trigonox®-21 initiator (0.125 g) in dil oil (1.125 g) to the vessel and reacting for 1 hour. This same finish-up procedure is repeated for another three times. Then dil oil (61.3 g) is added for final dilution, and stirred for 0.5 hour before being poured hot from the vessel. The final product is a viscous light yellow fluid.

Example 8 (EX8): is prepared in a similar manner to EX7, except allyl methacrylate (2.25 g), Trignox®-21 (1.5 g), and dodecyl mercaptan (1.5 g) are used.

Example 9 (EX9): is prepared in a similar manner to EX7, except allyl methacrylate (4.5 g), Trignox®-21 (3 g), and dodecyl mercaptan (3 g) are used.

Example 10 (EX10) is prepared by reacting Trigonox®-21 (40 g), C12-15 alkyl methacrylate (1600 g), methyl methacrylate (400 g), n-dodecylmercaptan (40 g) and mineral oil (1060 g) in a 4-necked 5 L round bottom flask equipped with an overhead stirrer, water-cooled condenser, $N_2$ inlet, thermocouple, and addition funnel, and a heating mantle. The reaction has a $N_2$ blanket for approximately 20 minutes whilst stirring. A portion of the reaction mixture (70%) is then transferred to the addition funnel. The TMPTMA (15.07 g) is then added to the remaining materials in the vessel. The reaction is heated to 95° C. Once the reaction reached 95° C., an exotherm occurs. After 30 minutes the temperature decreases from a maximum of 145° C. to 110° C. The remaining 70% weight of the monomers and the remaining Trigonox®-21 and n-dodecylmercaptan in oil is added dropwise at 110° C. The reaction mixture is stirred for one additional hour to give a final product.

Example 11 (EX11) is prepared by reacting Trigonox®-21 (2.5 g), alkyl methacrylate (80 g), methyl methacrylate (20 g), n-dodecylmercaptan (2.5 g), TMPTMA (1.6 g) and mineral oil (30 g) in a 4-necked 250 mL round bottom flask equipped with an overhead stirrer, water-cooled condenser, $N_2$ inlet, thermocouple and a heating mantle. The reaction has a $N_2$ blanket for approximately 20 minutes whilst stirring. The reaction mixture is then heated to 95° C. Once the reaction reaches 95° C., the exotherm increases the temperature to 110° C. The reaction is then stirred at 110° C. for two hour to give the final product.

Examples EX7 to EX11 are characterised as follows:

| | EX7 | EX8 | EX9 | EX10 | EX11 |
|---|---|---|---|---|---|
| Mw | 306,000 | 38,700 | 436,300 | 182,900 | 220,500 |
| Mn | 46,000 | 358,800 | 26,200 | 10,800 | 16,600 |
| Mp | 63,000 | 52,800 | 27,100 | 13,700 | 14,700 |
| PDI | 6.7 | 9.3 | 17.0 | 16.9 | 13.3 |

Reference Example 1 (RF1) is a commercially available linear polymethacrylate viscosity modifier.

Reference Example 2 (RF2) is prepared in a vessel equipped with a mechanical overhead stirrer, water-cooled condenser, thermocouple, and a nitrogen inlet. The vessel is charged with 700 g of $C_{12-15}$ alkyl methacrylate, 300 g of 2-ethylhexyl methacrylate, 351.9 g of mineral oil, 0.48 g of Trigonox®-21 initiator, and 1.21 g of cumyl dithiobenzoate. The vessel is then purged with 7.87 $cm^3/s$ (or 1.0 scfh) for 30 minutes. Nitrogen flow is then reduced to 3.94 $cm^3/s$ (or 0.5 scfh) before heating to 90° C. The vessel is maintained at 90° C. for 3 hours before cooling to ambient. The product is removed and analysed. The final product is a red viscous liquid and has a weight average molecular weight of 250,000 and a polydispersity of 1.3.

Reference Example 3 (RF3) is prepared in a similar process to RF2, except the polymer formed contains 70 wt % lauryl methacrylate and 30 wt % 2-ethylhexyl methacrylate. The polymer of RF3 has a weight average molecular weight of 109,000 and a polydispersity of 1.24.

Lubricating Compositions (LC1 to LC4) for Gear Oils

Lubricating compositions are prepared with the polymers of EX1, EX2, RF 1 and RF2. The lubricating compositions are blended to have a kinematic viscosity at 100° C. of about 19 $mm^2/s$ (or 19 cSt). The lubricating compositions contain a mixture of API Group III and Group IV base oils and contains conventional oil additives. In addition, the lubricating compositions contain 0.2 wt % of a polymethacrylate pour point depressant.

The lubricating compositions are evaluated by determining the kinematic and Brookfield viscosities (by employing ASTM methods D445 at 100° C. (KV100) and D2983 at −40° C. (BV-40) respectively). The viscosity index (VI) is also determined by employing ASTM method D2270. Shear stability index (SSI) is determined by employing a KRL bearing shear test (for 20 hours). The results obtained are as follows:

| Lubricating Composition | Polymer | % treat rate at 100° C. | VI | SSI | BV-40 |
|---|---|---|---|---|---|
| LC1 | RF1 | 25.9 | 187 | 49 | 49,000 |
| LC2 | RF2 | 10.72 | 188 | 87 | 18,400 |
| LC3 | EX1 | 25.02 | 205 | 49 | 44,000 |
| LC4 | EX2 | 8.08 | 248 | 82 | 22,000 |

The polymers of the invention are capable of providing to a lubricating composition improved VI values, whilst maintaining the same initial viscosity and shear stability as similar formulations with conventional linear polymers (or lubricating compositions containing the polymers from the RF1 and RF2). In addition, the polymers of the invention are capable of providing better or equal low temperature performance at a lower or equal treat rate compared with lubricating compositions containing the reference polymers.

Lubricating Compositions (LC5 to LC9) for Automatic Transmissions

Lubricating compositions with a kinematic viscosity of about 7.2 $mm^2/s$ (cSt) are prepared by blending the polymers of EX3, EX4, EX5, EX6 and RF3 into a 4 $mm^2/s$ Petro-Canada™ base oil. The lubricating compositions further contain a conventional additive package and 0.2 wt % of a polymethacrylate pour point depressant. The lubricating compositions are summarised as follows:

| Lubricating Composition | Example | Polymer Treat Rate (wt %) | KV100 | SSI | TE* |
|---|---|---|---|---|---|
| LC5 | EX3 | | Not Tested | | |
| LC6 | EX4 | 3.25 | 7.4 | 69 | 7.3 |
| LC7 | EX5 | | Not Tested | | |
| LC8 | EX6 | 1.45 | 7.7 | 72 | 16 |
| LC9 | RF3 | 4.31 | 7.23 | 69 | 4.3 |

*Thickening efficiency (TE) is calculated by the mathematical equation: TE = [log(viscosity of base oil + viscosity of polymer) − log(viscosity of base oil)]/(wt % treat rate of the polymer/100)

Lubricating Compositions LC10 to LC14 for Hydraulic Fluids

Lubricating compositions LC10 to LC12 are prepared with the polymers of EX7, EX8 and EX9 respectively. The lubricating compositions are blended to have a kinematic viscosity at 40° C. of about 46 $mm^2/s$ (or 46 cSt). The lubricating compositions contain a mixture of TOTAL™ 150N and TOTAL™ 600N base oils, and conventional oil additives. In addition, the lubricating compositions contain 0.4 wt % of a polymethacrylate pour point depressant.

Lubricating compositions LC13 to LC14 are prepared with the polymers of EX10 and EX11 respectively. The lubricating compositions are blended to have a kinematic viscosity at 40° C. of about 46 $mm^2/s$ (or 46 cSt). The lubricating compositions contain a mixture of Yubase™ 4 and Yubase™ 6, and conventional oil additives. In addition, the lubricating compositions contain 0.2 wt % of a polymethacrylate pour point depressant.

The lubricating compositions are evaluated by determining the kinematic and Brookfield viscosities (by employing ASTM methods D445 at 100° C. (KV100) and D2983 at −40° C. (BV-40) respectively). The viscosity index (VI) is also determined by employing ASTM method D2270. Shear stability index (SSI) is determined by employing an Orbahn shear 30 pass (ASTM D6278) or a KRL bearing shear test (for 20 hours). The results obtained are as follows:

| | LC10 | LC11 | LC12 | LC13 | LC14 |
|---|---|---|---|---|---|
| Polymer | EX7 | EX8 | EX9 | EX10 | EX11 |
| Wt % of Polymer* | 3.03 | 2.95 | 3.02 | 7.6 | 5.5 |
| LC Viscosity at 100° C. (cSt) | 8 | 8 | 8 | 8 | 8 |
| VI | 151 | 150 | 151 | 149 | 150 |
| Orbahn SSI | 21.3 | 22.1 | 34.7 | Not Run | Not Run |
| KRL SSI | Not Run | Not Run | Not Run | 32 | 40 |
| BV-40 | 166,000 | 200,000 | 212,000 | 80,000 | 82,000 |

Footnote:

*polymer amounts quoted include oil content of the product described in examples (EX7 to EX11).

Overall, the results indicate that the polymers of the invention provide lubricating compositions with higher thickening efficiency (TE) at the same initial viscosity and shear stability as comparative lubricating compositions containing a linear polymer.

As described hereinafter the molecular weight of the viscosity modifier has been determined using known methods, such as GPC analysis using polystyrene standards. Methods for determining molecular weights of polymers are well known. The methods are described for instance: (i) P. J. Flory, "Principles of Polymer Chemistry", Cornell University Press 91953), Chapter VII, pp 266-315; or (ii) "Macromolecules, an Introduction to Polymer Science", F. A. Bovey and F. H. Winslow, Editors, Academic Press (1979), pp 296-312.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy); and (iii) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, or no more than one, non-hydrocarbon substituent will be present for every ten carbon atoms in the hydrocarbyl group; typically, there will be no non-hydrocarbon substituents in the hydrocarbyl group.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements. As used herein any member of a genus (or list) may be excluded from the claims.

It is known that some of the materials described above may interact in the final formulation, so that the components of the final formulation may be different from those that are initially added. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

While the invention has been explained, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising:

(a) an oil of lubricating viscosity; and (b) a crosslinked polymer derived from monomers comprising:

(i) 0.001 wt % to 7 wt % of a di- or higher functional crosslinking monomer comprising a polymerisable (meth)acrylic, allyl, or vinyl group or mixtures thereof;

(ii) 30 wt % or higher of a hydrocarbyl-substituted (meth) acrylic monomer, wherein each hydrocarbyl contains greater than 8 carbon atoms; and (iii) 0 wt % to 40 wt % of a hydrocarbyl-substituted (meth) acrylic monomer, wherein each hydrocarbyl contains 8 or fewer carbon atoms; and (iv) 0 wt % to 10 wt % of a nitrogen containing monomer.

2. The lubricating composition of claim 1, wherein the crosslinked polymer comprises a random copolymer or a block copolymer.

3. The lubricating composition of claim 1, wherein the di- or higher functional crosslinking monomer comprises a tri (meth)acrylate, a tetra(meth)acrylate, an allyl (meth)acrylate, or reactive equivalents thereof, or mixtures thereof.

4. The lubricating composition of claim 1, wherein (b)(ii) and (b)(iii) are (meth)acrylic monomers comprising methacrylate esters, acrylate esters, as well as mixtures thereof, or reactive equivalents thereof.

5. The lubricating composition of claim 1, wherein the hydrocarbyl of the hydrocarbyl-substituted (meth)acrylic monomer (b)(ii), contains 9 to 30 carbon atoms.

6. The lubricating composition of claim 1, wherein the hydrocarbyl of the hydrocarbyl-substituted (meth)acrylic monomer (b)(iii), contains 1 to 8 carbon atoms.

7. The lubricating composition of claim 1 further comprising 1 wt % to 50 wt % of a conventional viscosity modifier, wherein the conventional viscosity modifier comprises hydrogenated copolymers of styrene-butadiene, polyolefins, olefin copolymers such as ethylene-propylene polymers, polyisobutenes, hydrogenated styrene-isoprene polymers, hydrogenated isoprene polymers, polymethacrylate esters, polyacrylate esters, polyalkylstyrenes, hydrogenated alkenyl arene conjugated diene copolymers, polyalkylmethacrylates or esters of maleic anhydride-styrene copolymers.

8. The lubricating composition of claim 7, wherein the conventional viscosity modifier comprises polymethacrylate acid esters, polyacrylate acid esters or mixtures thereof.

9. The lubricating composition of claim 8, wherein the polymethacrylate acid esters or polyacrylate acid esters are linear.

10. The composition of claim 1 further comprising at least one additional performance additive selected from the group consisting of metal deactivators, detergents, dispersants, friction modifiers, dispersant viscosity modifiers, extreme pressure agents, antiwear agents, antioxidants, corrosion inhibitors, foam inhibitors, demulsifiers, pour point depressants, seal swelling agents and mixtures thereof.

11. A method for lubricating a transmission, a gear, a hydraulic device or an internal combustion engine, comprising supplying thereto a lubricant comprising the composition of claim 1.

12. The composition of claim 1, wherein the di- or higher functional crosslinking monomer contains at least one moiety selected from the group consisting of (meth)acrylic, allyl, vinyl, styryl, conjugated double bonds, and mixtures thereof.

13. The lubricating composition of claim 1, wherein the crosslinked polymer is obtained by a process comprising reacting at a temperature of 45° C. or higher:

(i) 0.001 wt % to 7 wt % of a di- or higher functional crosslinking monomer comprising a polymerisable (meth)acrylic, allyl, or vinyl group or mixtures thereof;

(ii) 30 wt % or higher of a hydrocarbyl-substituted (meth) acrylic monomer, wherein each hydrocarbyl contains greater than 8 carbon atoms; and (iii) 0 wt % to 40 wt % of a hydrocarbyl-substituted (meth) acrylic monomer, wherein each hydrocarbyl contains 8 or fewer carbon atoms;

(iv) a free radical initiator; and (v) optionally a chain transfer agent; to form a crosslinked polymer.

14. The lubricating composition of claim 1 wherein the di- or higher functional crosslinking monomer comprises divinylbenzene.

15. A process for preparing a crosslinked polymer comprising reacting at a temperature of 45° C. or higher:

(i) 0.001 wt % to 7 wt % of a di- or higher functional crosslinking monomer comprising a polymerisable (meth)acrylic, allyl, or vinyl group or mixtures thereof;

(ii) 30 wt % or higher of a hydrocarbyl-substituted (meth) acrylic monomer, wherein each hydrocarbyl contains greater than 8 carbon atoms; and (iii) 0 wt % to 40 wt % of a hydrocarbyl-substituted (meth) acrylic monomer, wherein each hydrocarbyl contains 8 or fewer carbon atoms;

(iv) a free radical initiator; and (v) optionally a chain transfer agent; to form a crosslinked polymer.

16. The process of claim 15 further comprising adding or preparing a conventional polymer in the crosslinked polymer.

17. The process of claim 15, wherein the process comprises preparing the crosslinked polymer in a conventional polymer.

18. The process of claim 16, wherein the crosslinked polymer to conventional polymer weight percent ratio is 10:90 to 70:30.

19. The process of claim 15, wherein the crosslinked polymer is prepared by free radical polymerisation or controlled free radical polymerisation techniques.

20. The process of claim 19, wherein the controlled free radical polymerisation techniques include at least one of the group consisting of reversible addition-fragmentation chain transfer, atom transfer radical polymerisation and nitroxide-mediated stable free-radical polymerisation.

21. The process of claim 15, wherein the temperature is 80° C. to 150° C.

22. The process of claims 17, wherein the crosslinked polymer to conventional polymer weight percent ratio is 10:90 to 70:30.

* * * * *